US011407250B2

(12) United States Patent
Thoelen

(10) Patent No.: US 11,407,250 B2
(45) Date of Patent: Aug. 9, 2022

(54) METHOD AND SYSTEM FOR PRODUCING A MATERIAL BOARD

(71) Applicant: HUECK Rheinische GmbH, Viersen (DE)

(72) Inventor: Berthold Thoelen, Viersen (DE)

(73) Assignee: HUECK RHEINISCHE GMBH, Viersen (DE)

( * ) Notice: Subject to any disclaimer, the term of this patent is extended or adjusted under 35 U.S.C. 154(b) by 0 days.

(21) Appl. No.: 17/436,735

(22) PCT Filed: Mar. 6, 2020

(86) PCT No.: PCT/EP2020/055976
§ 371 (c)(1),
(2) Date: Sep. 7, 2021

(87) PCT Pub. No.: WO2020/187601
PCT Pub. Date: Sep. 24, 2020

(65) Prior Publication Data

US 2022/0185003 A1 Jun. 16, 2022

(30) Foreign Application Priority Data

Mar. 18, 2019 (DE) ..... 10 2019 106 856.8

(51) Int. Cl.
*B44C 1/24* (2006.01)
*B44F 9/04* (2006.01)
(Continued)

(52) U.S. Cl.
CPC ..... *B44C 1/24* (2013.01); *B44C 5/04* (2013.01); *B44F 9/02* (2013.01); *B44F 9/04* (2013.01)

(58) Field of Classification Search
CPC ..... B44C 5/04; B44C 1/24; B44F 9/04; B44F 9/02
See application file for complete search history.

(56) References Cited

U.S. PATENT DOCUMENTS 7,632,561 B2 * 12/2009 Thiers ..... B44C 1/24 52/592.4
8,316,604 B2 11/2012 Thiers
(Continued)

FOREIGN PATENT DOCUMENTS

AU 2002214967 B2 1/2006
CN 1618603 A 5/2005
(Continued)

OTHER PUBLICATIONS

International Search Report in PCT/EP2020/055976, dated Jun. 16, 2020.

*Primary Examiner* — David H Banh
(74) *Attorney, Agent, or Firm* — Collard & Roe, P.C.

(57) ABSTRACT

A method for producing a material board, which has a structured, colored surface, assigns image data to a colored digital image of a colored original surface. The image data is used to produce a first image data set and at least one second image data set, which are each assigned to different color channels of the colored digital image. A colored surface is produced on a base carrier using the at least one second image data set but without using the first image data set. The colored surface of the base carrier is pressed by use of a structured pressing surface of a pressing tool, in order to obtain the material board with the structured, colored surface. The structured pressing surface is assigned to the first image data set.

7 Claims, 4 Drawing Sheets

Figure 1:
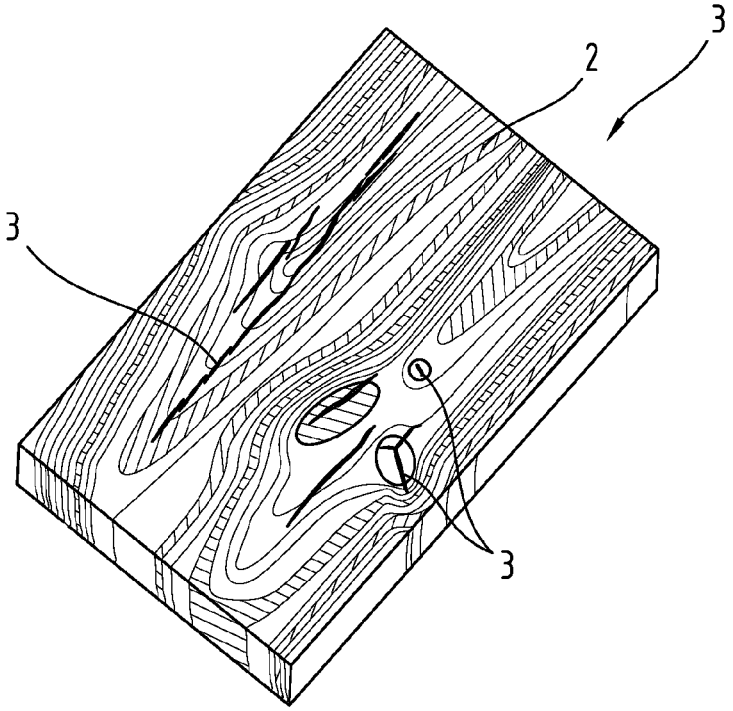

(51) Int. Cl.
*B44F 9/02* (2006.01)
*B44C 5/04* (2006.01)

(56) References Cited

U.S. PATENT DOCUMENTS

| | | | | |
|---|---|---|---|---|
| 10,029,452 | B2 | 7/2018 | Lehnhoff | |
| 10,315,410 | B2 | 6/2019 | Lehnhoff | |
| 2006/0144004 | A1 | 7/2006 | Nollet et al. | |
| 2009/0103801 | A1 | 4/2009 | Messler | |
| 2009/0151866 | A1* | 6/2009 | Endert | B32B 38/145 156/384 |
| 2009/0260307 | A1* | 10/2009 | Thiers | B44F 9/02 52/311.1 |
| 2014/0199531 | A1* | 7/2014 | Pervan | B05D 1/02 428/207 |
| 2016/0201324 | A1 | 7/2016 | Håkansson et al. | |
| 2017/0080747 | A1* | 3/2017 | Young | B32B 27/304 |
| 2019/0066367 | A1 | 2/2019 | Antunez | |

FOREIGN PATENT DOCUMENTS

| | | | |
|---|---|---|---|
| CN | 1895866 | A | 1/2007 |
| CN | 107253407 | A | 10/2017 |
| DE | 10 2013 101 521 | A1 | 8/2014 |
| EP | 2 060 658 | A2 | 5/2009 |
| EP | 3 141 400 | A1 | 3/2017 |
| JP | H08-25783 | A | 1/1996 |
| JP | 2004-312617 | A | 11/2004 |
| JP | 2005-067175 | A | 3/2005 |
| JP | 2006-012029 | A | 1/2006 |
| JP | 2008-541179 | A | 11/2008 |
| KR | 10-2008-0101471 | A | 11/2008 |
| KR | 10-2081991 | B1 | 5/2020 |
| RU | 2 402 427 | C2 | 10/2010 |

* cited by examiner

METHOD AND SYSTEM FOR PRODUCING A MATERIAL BOARD

CROSS REFERENCE TO RELATED APPLICATIONS

This application is the National Stage of PCT/EP2020/055976 filed on Mar. 6, 2020, which claims priority under 35 U.S.C. § 119 of German Application No. 10 2019 106 856.8 filed on Mar. 18, 2019, the disclosure of which is incorporated by reference. The international application under PCT article 21(2) was not published in English.

The invention relates to a method for producing a material board having a structured, colored surface.

EP 2 060 658 A2 discloses a press plate having a structured pressing surface. The structured pressing surface comprises a structure that has a mountain-like surface with valleys and heights. By use of the pressing surface, a material board with a structured surface may be produced. If the structured surface of the material board is colored, it is desirable for the structure of the surface to match the colored pattern of the surface as precisely as possible, which is why a synchronization as precise as possible during the pressing process is necessary. This is particularly important if the structured surface is, for example, assigned to a wood pattern or a natural stone pattern.

It is the object of the invention to indicate an easier method for producing a material board comprising a structured, colored surface.

The object of the invention is achieved by a method for producing a material board comprising a structured, colored surface, comprising the following method steps:

- providing image data assigned to a colored digital image of a colored original surface,
- generating, from the image data, a first image data set and at least one second image data set, each being assigned to different color channels of the colored digital image,
- producing a colored surface on a base carrier using the at least one second image data set without using the first image data set, and
- pressing the colored surface of the base carrier by use of a structured pressing surface of a pressing tool to obtain the material board with the structured, colored surface, wherein the structured pressing surface is assigned to the first image data set.

An exemplary application of the invention relates to a system for producing a material board comprising a structured, colored surface, comprising

- a pressing tool comprising a structured pressing surface which was produced using a first image data set, and
- at least one second image data set which is provided for producing a colored surface on a base carrier without using the first image data set, wherein the first image data set and the at least one second image data set are each assigned to different color channels of a colored digital image of a colored original surface, and the pressing tool is configured for pressing the colored surface of the base carrier by use of its structured pressing surface so as to obtain the material board with the structured, colored surface.

Thus, according to the invention, the pressing tool and the multiple image data sets are provided.

The pressing tool may, for example, be an embossing roller or an endless belt. The pressing tool preferably is a pressing plate.

The structured pressing surface is assigned to the first image data set and/or was produced using the first image data set. The structured pressing surface is, in particular, not assigned to the at least one second image data set and/or was, in particular, produced without using the at least one second image data set.

The first and the at least one second image data set are assigned to different color channels of the colored digital image.

A color channel comprises the information on the color components contained in the colored digital image. In particular, the number of color channels in a colored digital image depends on the used mode, color space and/or color model.

The individual color channels in particular comprise the color components of each pixel in the colored digital image. The multiple color channels may be assigned to each pixel.

According to the invention, at least one second image data set is provided. Thus, precisely one second image data set or multiple second image data sets may be provided.

As stated above, the image data sets are assigned to the selected color channels of the colored digital image. The colored digital image is an image of the colored original surface. The colored original surface, for example, is a flat colored original surface or preferably a structured colored original surface. The structure of the pressing surface is preferably assigned to the structure of the structured pressing surface.

The original surface is, for example, assigned to a wood pattern or a natural stone, in particular to a structured wood pattern or a structured natural stone.

The first image data set is used for the production of the structured pressing surface of the pressing tool. The structured pressing surface, in turn, is provided for being pressed with the base carrier such that the base carrier obtains the structured surface.

The base carrier for example comprises a base material board and/or is designed as a base material board which is provided with the colored surface. This surface may be provided with a resin or a plastic material layer prior to pressing with the pressing tool. This surface may be white or be provided with a basic color.

The base material board for example comprises a natural material, in particular wood. The base material board, for example, is a chipboard or a medium-density fiberboard. It may be treated prior to direct printing. After printing, a resin can still be applied or it can be pressed with a resined overlay. The base material board may also comprise a plastic material.

The base carrier, for example, is a paper which is provided with the colored surface and is, in particular, soaked in a resin prior to pressing and is optionally pressed with a carrier using the pressing tool. The carrier, for example, comprises a wood material. The carrier, for example, is a medium-density fiberboard or a chipboard.

The base carrier, for example, is a base material film which is provided with the colored surface. The base material film is, for example, made of a plastic material and, in particular, comprises multiple layers. The associated material board then, for example, is a so-called luxury vinyl tile (LVT).

The first image data set in case of the structured original surface in particular comprises an information on the structuring of this original surface which is accordingly transferred to the pressing surface and in consequence to the material board and/or to the base carrier. In particular, the pressing tool and/or its pressing surface is produced without using the second image data set.

The structure of the pressing surface may be produced by material removal, for example by etching or multiple etching, as is known from EP 2 060 658 A2. The structure of the pressing surface may also be produced using a material-adding method. The structure of the pressing surface, in particular, comprises the heights and valleys and/or raised and subjacent areas.

The structured pressing surface may have one single degree of gloss or multiple different degrees of gloss. The different degrees of gloss may be generated based on the first image data set. Based on the degrees of gloss, it is possible to provide the material board with a natural appearance. This is particularly advantageous for wooden or stone original surfaces.

The at least one second image data set is provided for coloring of the structured surface of the material board, which is why according to the invention the first image data set is not used for coloring of the surface of the material board, although it may comprise an information on the coloring of the original surface. Thereby, the color component of the structured, colored surface of the material board comprises no or just a relatively small amount of information on its structuring, whereby pressing of the base carrier using the pressing tool may be carried out with a relatively large tolerance. Thereby, the material board may be produced more quickly. Nevertheless, the structured surface of the material board has an at least sufficiently good appearance, which at least sufficiently well corresponds with the original surface.

If, in contrast, the coloring of the structured, colored surface also includes a significant information on the structuring, as is the case in conventional methods for producing a material board, pressing of the base material carrier using the pressing tool must be carried out at a higher precision, such that the structuring and its coloring run as synchronously as possible, which then results in an acceptable overall impression of the finished pressed material board.

To particularly adjust the degree of structuring of the pressing surface, in particular to reduce it, it may be provided that the first image data set is further processed, in particular that its information content is reduced, prior to the use for producing the structured pressing surface.

The surface of the base carrier may, for example, be printed onto with the aid of, for example, a digital color printer, using the at least one second image data set and without using the first image data set. In this case, the digital color printer is controlled by use of the at least one second image data set. Optionally, it may be provided that the at least one second image data set is further processed, for example by the at least one second image data set being transferred into color channels suitable for the digital color printer, prior to printing onto the surface.

The surfaces of the base carrier may, for example, be colored using color printing rollers. The color printing rollers are colored and transferred accordingly using the at least second image data set and without using the first image data set.

The material board, for example, comprises a wood material. The material board, for example, is medium-density fiberboards or chipboards.

The material board and/or the base carrier may, for example, comprise a plastic material. Said material may be treated prior to direct printing. After printing, a resin can still be applied, or it can be pressed with a resined overlay.

In addition to the structured, colored surface, the material board may comprise a further structured, colored surface. These two structured, colored surfaces are arranged opposite one another and are congruent. In order to obtain the further structured, colored surface, the following method steps may be carried out:

generating at least one third image data set from the at least one second image data set by axisymmetric mirroring of the at least one second image data set, producing a further colored surface on the base carrier using the at least one third image data set without using the first image data set, wherein the colored surface and the further colored surface are congruent and arranged opposite one another, and pressing the further colored surface of the base carrier using a structured pressing surface of a further pressing tool, so as to obtain a material board with a further structured, colored surface, which is congruent to and arranged opposite to the structured, colored surface, wherein the structured pressing surface is assigned to the first image data set, is, however, axisymmetric with respect to the pressing surface of the pressing tool in such a way that the structured, colored surface and the further structured, colored surface are congruent.

Figure 2:
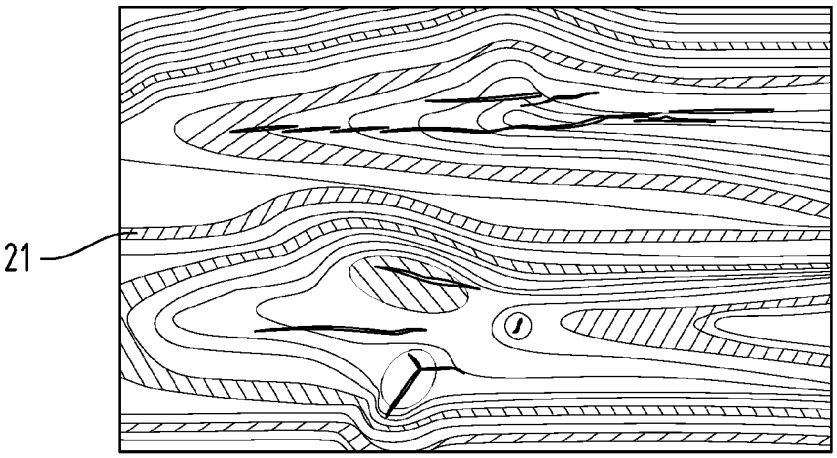
Figure 3:
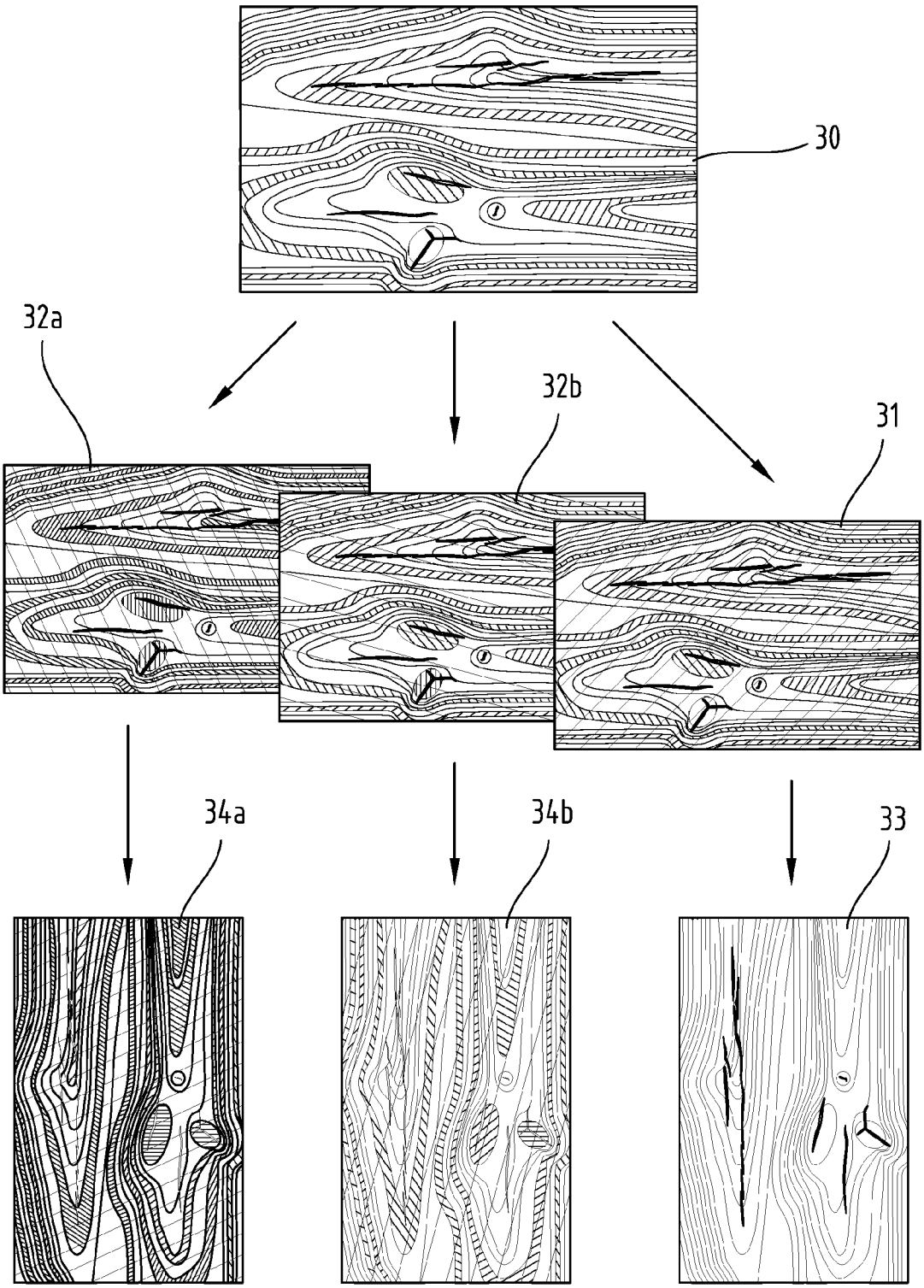
Figure 4:
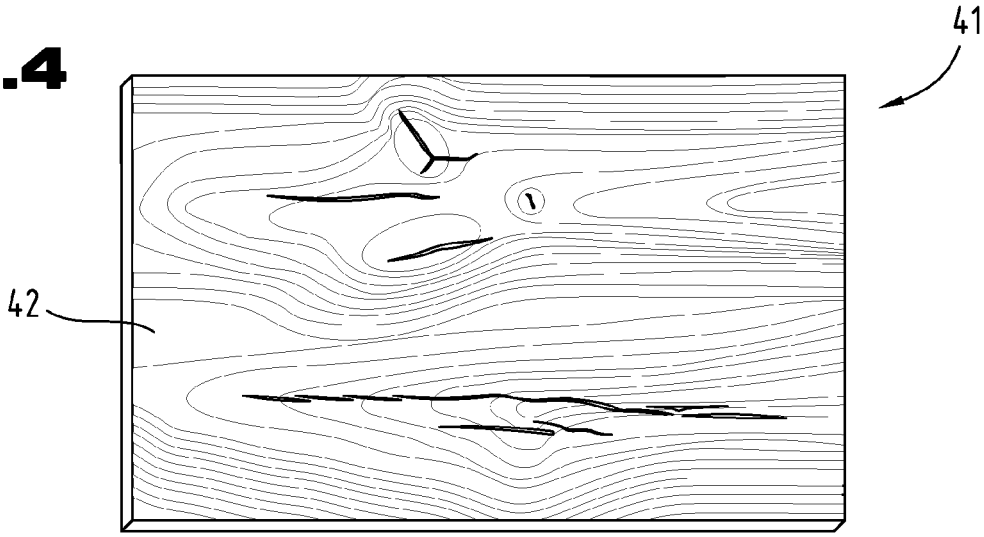
Figure 5:
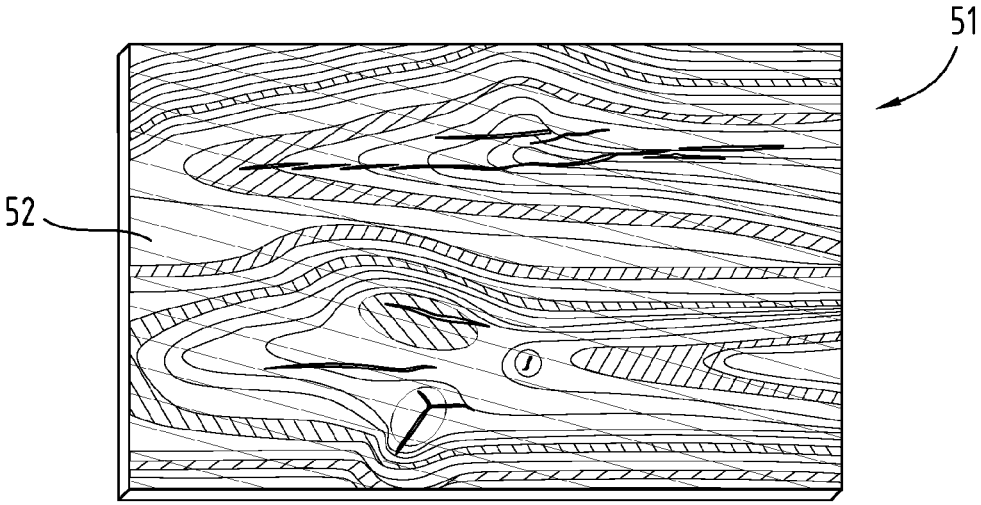
Figure 6:
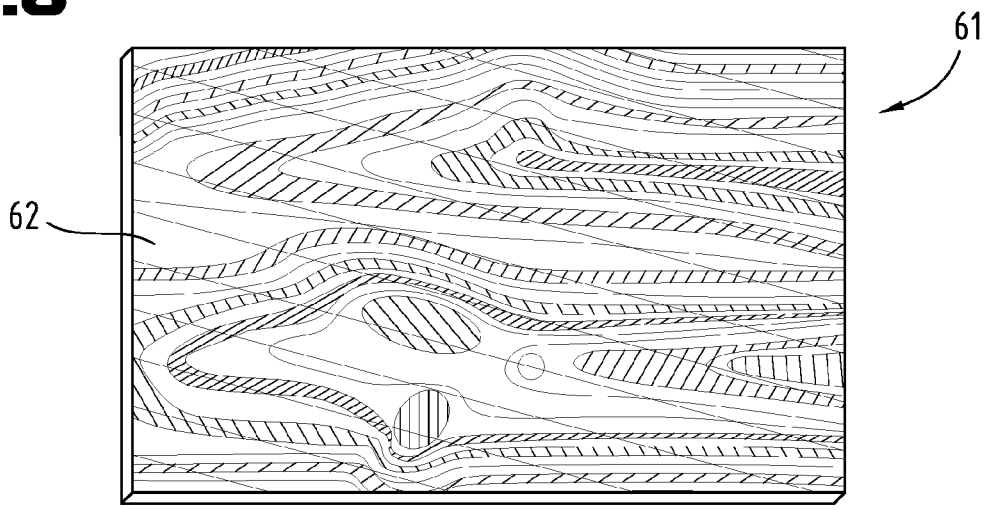
Figure 7:
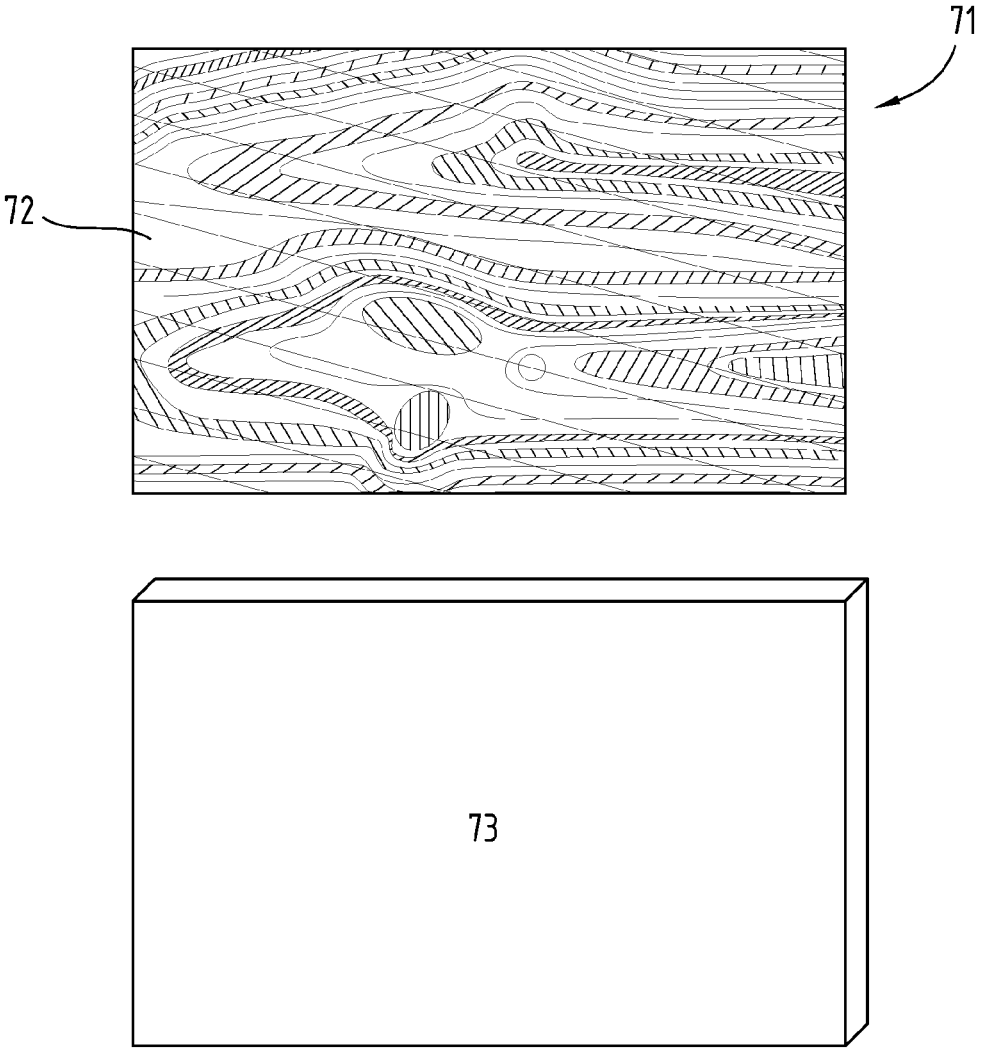

Exemplary embodiments of the invention are shown in the enclosed schematic figures by way of example. These show:

FIG. 1 a top view of a structured, colored original surface,

FIG. 2 a top view of a colored digital image of the structured, colored original surface, FIG. 3 image data assigned to the colored digital image, FIG. 4 a pressing plate with at least one structured pressing surface, FIG. 5 a material board, FIG. 6 a base material board, and FIG. 7 a paper and a carrier.

FIG. 1 shows the top view of a structured, colored original surface 1, which in the case of the present exemplary embodiment is assigned to a natural wood pattern. The colored original surface 1 may also be flat.

The structured, colored original surface 1 in particular comprises a colored pattern 2 and a structure 3 formed by subjacent and raised areas in the original surface 1.

FIG. 2 shows a colored digital image 21 of the structured, colored original surface 1.

Image data 30 shown in FIG. 3 is assigned to the colored digital image 21.

A first image data set 31 and at least one second, in the case of the present exemplary embodiment multiple second, image data sets 32*a*, 32*b* are generated from the image data 30.

The first image data set 31 and the second image data sets 32*a*, 32*b* are each assigned to different color channels of the colored digital image 21.

The first image data set 31 is provided for the production of a pressing tool having a structured pressing surface. The pressing tool, for example, is a pressing plate 41 shown in FIG. 4 which comprises a structured pressing surface 42. The pressing tool may also be a pressing roller having a structured pressing surface or an endless belt having a structured pressing surface.

In the case of the present exemplary embodiment, the structured pressing surface 42 is assigned to the first image data set 31 and/or was produced using the first image data set 31 and without using the second image data set 32*a*, 32*a*. The first image data set 31 may be further processed, in particular be reduced such that, for example, a further processed first image data set 33 emerges, prior to the production of the pressing plate 41 and/or its structured pressing surface 42. In the case of the present exemplary embodiment, the further processed first image data set 33 is used for the production of the pressing plate 41 and/or its pressing surface 42.

The structured pressing surface 42 may have one single degree of gloss or multiple different degrees of gloss. The different degrees of gloss may be generated based on the first image data set 31 and/or the further processed first image data set 33.

The structured pressing surface 42 is provided for producing a material board 51, which comprises a structured, colored surface 52, shown in FIG. 5.

The material board 51 is, for example, made from a plastic material or comprises a wooden material board.

To obtain the structured, colored surface 52, for example, first, the relevant surface of a base material board 61 shown in FIG. 6 as an example of a base carrier is processed using the second image data sets 32 without using the first image data set 31, such that the base material board 61 obtains a colored surface 62. Optionally, the two second image data sets 32*a*, 32*b* are previously further processed, in particular further processed manually, such that further processed second image data sets 34*a*, 34*b* emerge which may be used for processing and/or printing onto the base material board 61.

To obtain the colored surface 62, for example, a digital color printer is used, or accordingly colored color printing rollers are used. Optionally, image data sets, which are suitable for controlling the digital color printer, can be automatically generated from the second image data sets 32*a*, 32*b* and/or the further processed second image data sets 34*a*, 34*b*.

Subsequently, in the case of the present exemplary embodiment, the colored surface 62 of the base material board 61 is provided with a resin or a plastic material film and is pressed with the pressing plate 41 and/or its structured pressing surface 42, such that the material board 51 with its structured, colored surface 52 emerges.

FIG. 7 shows a paper 71 with a colored surface 72 as a further example of a base carrier. To obtain the colored surface 72, the relevant surface of a paper was processed using the second image data sets 32 without using the first image data sets 31. Optionally, the two second image data sets 32*a*, 32*b* are previously further processed, in particular further processed manually, such that further processed second image data sets 34*a*, 34*b* emerge which may be used for processing and/or printing onto the paper 71.

To obtain the colored surface 72, for example, a digital color printer is used, or accordingly colored color printing rollers are used. Optionally, image data sets, which are suitable for controlling the digital color printer, can be automatically generated from the second image data sets 32*a*, 32*b* and/or the further processed second image data sets 34*a*, 34*b*.

To obtain the material board 51, in particular, the paper 71 is soaked in a resin and is subsequently pressed with a carrier 73 and using the pressing plate 41 and/or its structured pressing surface 42, such that the material board 51 with its structured, colored surface 52 emerges.

The carrier 73 is, for example, made from a plastic material or comprises a wooden material board.

In addition to the structured, colored surface 52, the material board 51 may comprise a further structured, colored surface. These two structured, colored surfaces are arranged opposite one another and are congruent. To obtain the further structured, colored surface, for example, two third image data sets may be generated from the two second image data sets (32*a*, 32) by axisymmetric mirroring of the two second image data sets (32*a*, 32). Subsequently, a further colored surface may be produced on the base carrier using the two third image data sets, wherein the colored surface and the further colored surface are congruent and arranged opposite one another.

The further colored surface of the base carrier is then, for example, pressed using a structured pressing surface of a further pressing tool, so as to obtain a material board with a further structured, colored surface.

The invention claimed is:

1. A method for producing a material board (51), which comprises a structured, colored surface (52), comprising the following method steps:

providing image data (30) assigned to a colored digital image (21) of a colored original surface (1);

generating, from the image data (30), a first image data set (31) and at least one second image data set (32*a*, 32*b*), each being assigned to different color channels of the colored digital image (21);

producing a colored surface (62, 72) on a base carrier (61, 71) using the at least one second image data set (32*a*, 32*b*) without using the first image data set (31); and pressing the colored surface (62, 72) of the base carrier (61, 71) by use of a structured pressing surface (42) of a pressing tool (41) to obtain the material board (51) with the structured, colored surface (52), wherein the structured pressing surface (42) was produced using the first image data set (31) and thus is assigned to the first image data set (31).

2. The method according to claim 1, wherein producing a colored surface (62, 72) on a base carrier (61, 71) is carried out by printing, preferably with a digital color printer or by use of color printing rollers.

3. The method according to claim 1, wherein the colored original surface (1) is a structured, colored original surface.

4. The method according to claim 1, wherein the original surface (1) is assigned to a wood pattern or a natural stone, in particular to a structured wood pattern or a structured natural stone.

5. The method according to claim 1, in which the first image data set (31) is further processed to adapt the degree of structuring of the pressing surface (42), in particular reduce it, prior to the use for producing the structured pressing surface (42).

6. The method according to claim 1, wherein the pressing surface (42) has different degrees of gloss which were produced using the first image data set (31).

7. The method according to claim 1, comprising the following method steps:

generating at least one third image data set from the at least one second image data set by axisymmetric mirroring of the at least one second image data set;

producing a further colored surface on the base carrier using the at least one third image data set without using the first image data set, wherein the colored surface and the further colored surface are congruent and arranged opposite one another; and pressing the further colored surface of the base carrier using a structured pressing surface of a further pressing tool, so as to obtain a material board with a further structured, colored surface, which is congruent to and arranged opposite to the structured, colored surface, wherein the structured pressing surface is assigned to the first image data set, is, however, axisymmetric with respect to the pressing surface of the pressing tool in such a way that the structured, colored surface and the further structured, colored surface are congruent.

* * * * *